US006341778B1

(12) United States Patent
Lee

(10) Patent No.: US 6,341,778 B1
(45) Date of Patent: Jan. 29, 2002

(54) METHOD FOR PLAYING POINTSPREAD BLACKJACK

(76) Inventor: John S. Lee, 914-40 Alexander Street, Toronto (CA)

( * ) Notice: Subject to any disclaimer, the term of this patent is extended or adjusted under 35 U.S.C. 154(b) by 0 days.

(21) Appl. No.: 09/449,518

(22) Filed: Nov. 29, 1999

(51) Int. Cl.[7] ..... A63F 1/00

(52) U.S. Cl. ..... 273/292; 273/274; 273/85 CP; 273/303; 273/309

(58) Field of Search ..... 273/292, 309, 273/274, 303, 85 CP

(56) References Cited

U.S. PATENT DOCUMENTS

| | | | | | |
|---|---|---|---|---|---|
| 3,667,757 | A | | 6/1972 | Holmberg | |
| 4,861,041 | A | | 8/1989 | Jones et al. | |
| 5,098,107 | A | | 3/1992 | Boylan et al. | |
| 5,154,429 | A | | 10/1992 | Levasseur | |
| 5,257,810 | A | | 11/1993 | Schorr et al. | |
| 5,275,416 | A | | 1/1994 | Schorr et al. | |
| 5,288,077 | A | | 2/1994 | Jones | |
| 5,364,105 | A | | 11/1994 | Jones | |
| 5,413,353 | A | | 5/1995 | Demarest et al. | |
| 5,417,430 | A | | 5/1995 | Breeding | |
| 5,454,570 | A | | 10/1995 | Karal | |
| 5,632,485 | A | | 5/1997 | Woodland et al. | |
| 5,636,843 | A | * | 6/1997 | Roberts | 273/292 |
| 5,660,391 | A | | 8/1997 | Klasee | |
| 5,673,917 | A | | 10/1997 | Vancura | |
| 5,735,524 | A | * | 4/1998 | Wisted | 273/274 |
| 5,799,946 | A | | 9/1998 | Groussman | |
| 5,810,360 | A | | 9/1998 | Srichayaporn | |
| 5,816,918 | A | * | 10/1998 | Kelly et al. | 463/16 |
| 5,823,536 | A | * | 10/1998 | Flasch | 273/292 |
| 5,829,750 | A | * | 11/1998 | Booker | 273/292 |
| 5,836,586 | A | * | 11/1998 | Marks et al. | 273/292 |
| 5,839,730 | A | | 11/1998 | Pike | |
| 5,984,308 | A | * | 11/1999 | Herrmann | 273/292 |
| 6,062,564 | A | * | 5/2000 | Terminel | 273/292 |
| 6,095,525 | A | * | 8/2000 | Terminel | 273/274 |
| 6,113,102 | A | * | 9/2000 | Marks et al. | 273/292 |
| 6,126,166 | A | * | 10/2000 | Lorson et al. | 273/148 R |

* cited by examiner

*Primary Examiner*—Benjamin H. Layno
*Assistant Examiner*—Dolores R. Collins
(74) *Attorney, Agent, or Firm*—Nath & Associates PLLC; Todd L. Juneau; Marvin C. Berkowitz

(57) ABSTRACT

The invention comprises a method for increasing the payout for the main wager of the game of blackjack or Twenty-One and/or for providing a side bet opportunity during the game of blackjack or Twenty-One which are based upon the point-spread between the players hand and the dealers hand. In one embodiment, a pointspread of 1, 2, 3, or 4 would result in 1×, 1.5×, 2×, or 10× payout, respectively, of the side wager. In another embodiment, a pointspread of 1, 2, 3, or 4 would result in 1×, 2×, 3×, or 5× payout, respectively, of a side bet. In another embodiment, a pointspread of 0, 1, 2, 3, or 4 would result in 0.5× , 1× , 1.5× , 3× , or 5× payout, respectively, of a side bet. The game allows for variations in the rules and for other types of side-betting opportunities while maintaining the excitement of a multiple pointspread payout at the resolution of the hand.

32 Claims, 4 Drawing Sheets

FIG. 4A

| | |
|---|---|
| WIN BY 1 | PAY 1X POINTSPREAD BET |
| WIN BY 2 | PAY 1.5X POINTSPREAD BET |
| WIN BY 3 | PAY 2 X POINTSPREAD BET |
| WIN BY 4 | PAY 10X POINTSPREAD BET |

FIG. 4B

| | |
|---|---|
| WIN BY 1 | PAY 1X POINTSPREAD BET |
| WIN BY 2 | PAY 2X POINTSPREAD BET |
| WIN BY 3 | PAY 3X POINTSPREAD BET |
| WIN BY 4 | PAY 5X POINTSPREAD BET |

FIG. 4C

| | |
|---|---|
| TIE | PAY 0.5X POINTSPREAD BET |
| WIN BY 1 | PAY 1X POINTSPREAD BET |
| WIN BY 2 | PAY 1.5X POINTSPREAD BET |
| WIN BY 3 | PAY 3X POINTSPREAD BET |
| WIN BY 4 | PAY 5X POINTSPREAD BET |

METHOD FOR PLAYING POINTSPREAD BLACKJACK

BACKGROUND OF THE INVENTION

1. Field of the Invention

The present invention relates to a method of playing a game of blackjack or Twenty-One. More specifically, the method of the present invention is a method for providing a side bet opportunity during the game of blackjack or Twenty-One which is based upon the pointspread between the players hand and the dealers hand.

2. Background of the Art

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involve continuous wagering opportunities for the players thus increasing player participation and excitement. Lastly, the games move fairly quickly to maintain action and activity. All of these factors have created games which are widely accepted and widely known.

Wagering games have been described in many previous publications. U.S. Pat. No. 5,364,105 and U.S. Pat. No. 5,288,077 both outline the addition of a progressive jackpot component to a Twenty-One game wherein wagers are received for participation in this jackpot component and these wagers are accumulated over a period of time to create a large jackpot. Following completion of a hand, the players may win a jackpot payout based on the final hand received by the player.

U.S. Pat. No. 5,673,917 to Vancura discloses a game wherein a side bet payout is based upon the number of hits each player and/or the dealer ultimately make.

U.S. Pat. No. 5,799,946 to Groussman discloses a game called "Texas 21 Wager" wherein a side bet is doubled for a win and the player loses if he or she loses the hand or if the dealer's up card is either a 3, 4, 5 or 6.

U.S. Pat. No. 5,839,730 to Pike discloses a game having a side bet opportunity wherein additional winnings independent of the main game may be made based upon the receipt of predetermined card configurations when taking hits.

U.S. Pat. No. 5,823,536 discloses a game where the dealer and banking functions are split or a "vigorish". U.S. Pat. No. 5,810,360 discloses a game where there is no house altogether and the players play against one another. Another game, U.S. Pat. No. 5,413,353, discloses a player vs. player game wherein the amount that is wagered goes into a "pot" in the case of ties and continues to grow from hand to hand until a winner gets a Twenty-One.

U.S. Pat. No. 5,632,485 discloses a game where there a various side bet options depending on whether the dealer receives a "stiff hand" or 12–16, or a "soft hand". U.S. Pat. No. 5,660,391 discloses a game wherein the player may bet whether the dealer will make 21 in four cards or less.

Some examples of modified black jack games can be found in U.S. Pat. No. 5,154,429 to LeVasseur, U.S. Pat. No. 5,257,810 to Schorr et al., U.S. Pat. No. 5,275,416 to Schorr et al., and U.S. Pat. No. 5,288,077 to Jones. Variations in wagering structures can also increase the excitement and acceptance of such wagering games. U.S. Pat. No. 5,417,430 discloses a poker game with an altered wagering scheme thus allowing the player the opportunity to compete for an additional prize or payout.

Other variations can be made to standard games to allow more player opportunity and involvement. U.S. Pat. No. 5,098,107 discloses a game wherein additional symbols are added to increase wagering opportunities. This allows the player the opportunity to place several wagers on different portions of the game while the game is being played. Somewhat similarly, U.S. Pat. No. 3,667,757 discloses a board game wherein the player is given choices regarding alternative strategies for play. Naturally the different strategies chosen have different payoff results. Unfortunately, this game is somewhat complicated and requires a considerable amount of time for the players to learn.

In the play of a Twenty-One game, there are many well understood strategies for players to follow. One publication outlining these strategies is Jerry L. Patterson and Eddie Olsen "Break the Dealer", 1986, Putnam Publishing Group. Generally, this strategy involves the player surveying their dealt cards, the dealer's displayed card, and making appropriate decisions based thereon. For example, if a player has a card total of eleven (11), the player should take a hit regardless of the dealer's displayed card. If, however, the player has a card total of twelve (12), the player should then consider the dealer's displayed card. A hit should be taken if the dealer's displayed card is a 2, 3, 7–10 or Ace. Other cards displayed by the dealer will suggest much different decisions by the player.

Some twenty-one tables offer a side bet game called "Over-Under" or some variation thereof. In addition to the normal markings on the table which are desirable for play of twenty-one (designated spaces for cards, designated spaces for bets, etc.), tables where Over-Under are played also have two additional designated areas for bets Usually the designated areas for the additional side bet is in the form of circles. Each circle identifies a specific bet, either "Over Thirteen" or "Under Thirteen." Before the turn of the first card in each hand of twenty-one, each player may place a bet as to whether the first two cards will total "Over Thirteen" or "Under Thirteen" by placing a bet in the appropriate circle. An amount of money equal to or less than the basic twenty-one wager may be placed in either circle. After the deal of the first two cards to each player, but before conclusion of the hand, wagers made on the side bet game of Over-Under have their wagers paid off or captured by the house. If the bet was Over Thirteen and the total of the cards was over thirteen, the house would pay equal odds on the wager. If the total count of the first two cards was thirteen or under, the house would capture the bet. Ties in this game (any total of thirteen) always allows the house to capture the bet. This side game has attained some level of acceptance and popularity, but pay outs are limited to one-to-one ratios, with no special awards or multiplication of bets available to increase the excitement of the game.

Another well known side bet is the opportunity to make an insurance wager. U.S. Pat. No. 5,454,570 discloses such an game where a player can buy insurance against a dealer's "good" hand.

U.S. Pat. No. 5,829,750 provide a means for players to wager on the occurrence of particular categories of black jacks using ranks and suits to determine categories. Black jacks may be grouped into at least six different categories, each category representing a particular arrangement of cards. These categories may include the following:

1. standard black jacks;
2. rank black jacks;
3. suited black jacks;
4. certain suited black jacks;
5. suited rank black jacks; and
6. certain suited rank black jacks.

These categories may be used to categorize any player's and a dealer's hand.

A standard black jack is the broadest category and it is a combination of any ace and any card with the value of ten (ten value card). No particular rank or suit is required. Under standard rules, kings, queens, jacks, and tens of any suit have a value of ten.

The use of these categories to make wagers has many advantages. Players are allowed to wager on the different categories of black jacks and find the black jack game more interesting and enjoyable than the standard game. Further, because the expected frequency of occurrence (odds) of some of the categories is small, very large pay outs and bonuses can be offered to players.

However, the sheer number and variety of ranks and blackjacks increases the complexity of this game and requires complicated payout tables, which in turn provides for slower play Some of these categories require the concurrent use of two or more decks of cards in the game depending upon the number of hands and the categories applied.

In summary, it is desired to find a game that is easy to play and also fast moving. When the player is provided with a considerable amount of participation, and additional winnings based on card combinations not related to the base game, these games become much more strategic and enjoyable. Furthermore, a game is more exciting if a player feels anticipation and excitement from a number of different sources throughout the game.

The present invention may also be used as the basis for players to make main wagers and/or additional wagers. Wagers on these pointspreads are easy for new players to understand and to calculate and increases the speed and therefor, the excitement of the game. Further, pointspread blackjack, due to it's simplicity, may be utilized alone or in combination with other games. All this may be achieved by modifying existing black jack games and does not require casinos to remove existing games.

SUMMARY OF THE INVENTION

The invention comprises a method for providing a side bet opportunity during the game of blackjack or Twenty-One which are based upon the point-spread between the players hand and the dealers hand. In an alternative embodiment, the invention consists of a method for increasing the payout for the main wager of the game of blackjack or Twenty-One based on the pointspread. The invention also includes a method for calculating the house advantage (or odds) of a game of pointspread blackjack depending on the number of decks of playing cards used, the number of pointspread opportunities (1–4 vs. 0–4), and the amount or multiplier of the payout.

In the preferred embodiment of the invention, a method of providing an additional wagering opportunity based on a pointspread between a dealer's hand and each player's hand in a black jack card game with money, gaming chips, and/or credits by one or more players playing against a dealer is provided, the method comprising the steps of:

(a) providing each player an opportunity to make a main wager to participate in the black jack card game and an opportunity to make a side wager representing a wager on the pointspread between the dealer's hand and each player's hand;

(b) the dealer dealing each player a player hand of two cards, and the dealer dealing a dealer hand of two cards, and the player and the dealer taking hits according to the rules of black jack;

(c) comparing each of the players'hands with the dealer's hand and the dealer resolving the main wagers by paying off winning players and taking the wagers of losing players according to the rules of blackjack; and (d) paying each player's side wager according to the pointspread between the dealer's hand and each player's hand and according to a payoff table.

In another embodiment, the point spread is based upon the main wager rather than the side wager, and includes a method of playing a black jack card game with money, gaming chips, and/or credits by one or more players playing against a dealer, the method comprising the steps of:

(a) providing each player an opportunity to make a wager to participate in the black jack card game;

(b) the dealer dealing each player a player hand of two cards, and the dealer dealing a dealer hand of two cards, and the player and the dealer taking hits according to the rules of black jack;

(c) comparing each of the players'hands with the dealer's hand and the dealer resolving the wagers by taking the wagers of losing players according to the rules of blackjack and paying off winning players according to the pointspread between the dealer's hand and each player's hand and according to a payoff table.

Similarly, another preferred embodiment of the invention wherein the pointspread is based on the main wager and not the side wager includes a method of providing an increased payout in a black jack card game with money, gaming chips, and/or credits by one or more players playing against a dealer, the method comprising the steps of:

(a) providing each player an opportunity to make a wager to participate in the black jack card game;

(b) the dealer dealing each player a player hand of two cards, and the dealer dealing a dealer hand of two cards, and the player and the dealer taking hits according to the rules of black jack;

(c) comparing each of the players'hands with the dealer's hand and resolving the main wagers by taking the wagers of losing players according to the rules of blackjack and paying off winning players according to the pointspread between the dealer's hand and each player's hand and according to a payoff table.

BRIEF DESCRIPTION OF THE DRAWINGS

FIG. 1 shows each player having a main wagering area and one pointspread wagering area for placing a wager on the pointspread between the dealer hand and the player's hand.

FIG. 2 shows each player having a main wagering area and two additional wagering areas, one pointspread wagering area for placing a wager on the pointspread between the dealer hand and the player's hand, and one wagering area for placing an insurance wager.

FIG. 3 shows each player having a main wagering area and four pointspread wagering area for placing a wager on the pointspread between the dealer hand and the player's hand wherein a wager on a pointspread of one would be placed on the area designated "1", a wager on a pointspread of two would be placed on the area designated "2", and so forth for wagers on pointspreads of three, four and/or zero (a tie).

FIG. 4 is a representation of a payout table such as would be available for calculating the pointspread payout for a particular hand. FIG. 4 shows payout tables or payoff tables which can be set up to provide a payout equal to various multiples of any wager. FIG. 4A shows an example wherein a pointspread of 1, 2, 3, or 4 pays a multiples of 1×, 1.5×, 2×, or 10×, respectively, resulting in one type of house advantage. FIG. 4B shows an example wherein a pointspread of 1, 2, 3, or 4 pays a multiples of 1×, 2×, 3×, or 5×, respectively, resulting in another type of house advantage. FIG. 4C shows an example wherein a pointspread of 0 (a tie), 1, 2, 3, or 4 pays a multiples of 0.5×, 1×, 1.5×, 3×, or 5×, respectively, resulting in yet another type of house advantage.

DETAILED DESCRIPTION OF THE INVENTION

Figure 1:
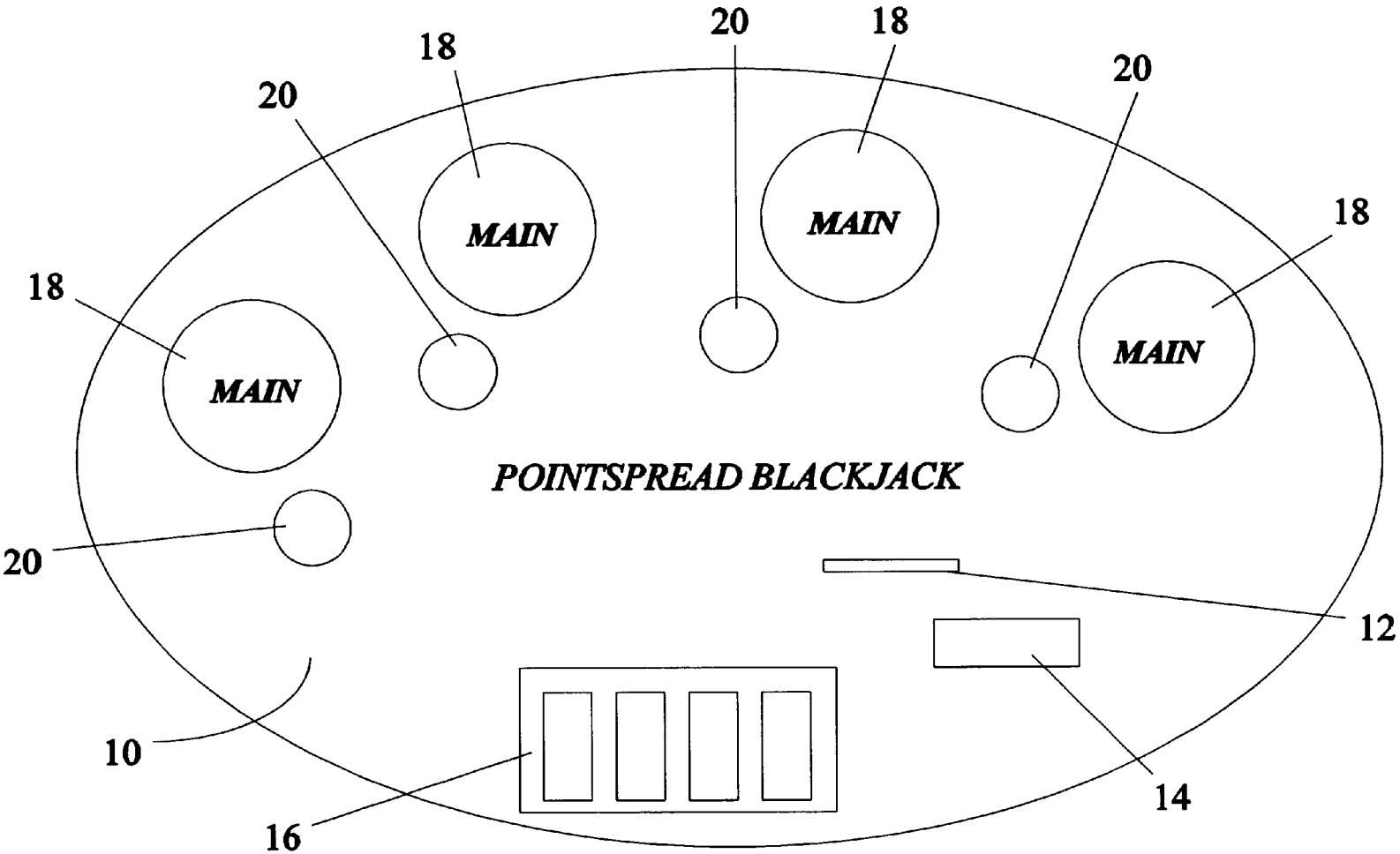
FIG. 1 is a top view of a gaming table layout of one embodiment of the game of the invention.

In a most preferred embodiment, pointspread blackjack is a side bet for normal blackjack. For purposes of odds/percentage calculations, the following rules are used:

i) the dealer hits soft 17;

ii) hands can be split up to three times, i.e. a player can have up to four hands per position;

iii) split hands can be doubled down;

iv) split aces receive one card each and cannot be hit again.

In this embodiment, Pointspread Blackjack differs from normal blackjack in how a player wins. As the name implies, Pointspread Blackjack pays the player based on the point difference between the winning player's hand and the dealer's. For example, if a player has 20 and the dealer has 18, the player is paid for a two (2) point difference. Thus, the player can win by one (1) to four (4) points under normal rules.

Where there is a split calculation, the house advantage may be calculated in an actual sense or by simulation due the fact that many split calculations lead to exponential outcomes.

In another embodiment, players would be paid for ties (where the pointspread equals zero) and/or for dealer busts as well. For example, a player blackjack with a dealer bust would conceivably result in a situation where no pointspread would exist. In such a situation, the player is given a standard or default pointspread payout or, alternatively, is given an insurance option. One example of an insurance option is where the player is offered an immediate 1.5× main wager payout or the option of a higher pointspread payout with the risk of not being paid at all upon a dealer bust.

In a preferred embodiment, natural blackjacks are treated no differently than any other 21 obtained with more than 2 cards. Variations on the treatment of other types of blackjacks are known in the art and are encompassed within the scope of this invention. Preferably, the pointspread bet is lost if the player busts. However, variations within the scope of the invention include situations where the main bet is won while the pointspread lost, or where the pointspread wager is won while the main wager is lost.

If the embodiment where the pointspread is lost upon a bust, it is preferable to increase the payout to compensate for this more robust variation in order to entice players toward assuming a higher level of risk.

In a preferred embodiment, the pointspread cannot exceed the amount of the main wager in order to stay within calculated house advantages.

Examples of particular pointspread pay outs are found in FIG. 4. FIG. 4A provides that a pointspread of 1, 2, 3, or 4 results in 1×, 1.5×,, 2× or 10× payout, respectively, of the pointspread wager. In this scheme, where a player uses a basic strategy, the theoretical house advantage ranges from 5.15% for 2 decks of cards in the dealer tray to 5.32% for six decks. Alternatively, if a player mimics the dealer, i.e. the strategy where he hits to 17 regardless of the dealer's up card, the house percentage drops to 2.43% for 2 decks to 2.53% for 6 decks. Importantly, where a player mimics the dealer there is a significant increase in the house edge as far as the main wager is concerned and results in an advantage of 5.5% to 5.7% advantage according to *The World's Greatest Blackjack Book*, Humble and Cooper.

In another example shown in FIG. 4B, a pointspread of 1, 2, 3, or 4 results in 1×, 2×, 3×, or 5× payout, respectively, of the pointspread wager. In this scheme, a player using the basic strategy results in a house advantage of 6.25% for 2 decks to 6.36% for 6 decks of cards in the dealer tray. Where a player using the dealer mimic strategy the advantage is 3.77% for 2 decks to 3.80% for 6 decks.

In another example, a pointspread of 0 (a tie), 1, 2, 3, or 4 results in 0.5×, 1×, 1.5×, 3× or 5× payout, respectively, of a side bet. The house advantage for when a player uses the basic strategy provides odds of 5.19% for 2 decks to 5.28% for 6 decks. The advantage for a player using the mimic strategy results in 2.56% for 2 decks and 2.57% for 6 decks.

Software programs for calculating the house advantage percentages of any particular pointspread blackjack game are within the scope of the present invention. Flowchart diagram exemplifying functional steps or objects which may be used to achieve a particular percentage are within the level of skill in the art and may include steps relating to: inputting data, variables, and/or objects relating to the basic game of blackjack; inputting data, variables and/or objects relating to pointspread blackjack and in particular to the amount of the pointspread and the payout multiple as well as the number of decks used by the house; and determining or calculating the value of the advantage of the house over each particular player. It is well known in the art that programming may be structured in a variety of different ways using a variety of different languages to achieve a particular result. Such variation, as well as any improvement thereto, is contemplated as within the scope of the invention.

Pointspread blackjack allows for variations in the rules and for other types of side-betting opportunities while maintaining the excitement of a multiple pointspread payout at the resolution of the hand.

The present method provides a player with the opportunity to place an additional wager or side bet while playing Blackjack or Twenty-One. In the process of playing the game, the player will initially place their normal wager for Blackjack or Twenty-One (hereinafter "base game"). Prior to dealing the cards, the player will also be given the opportunity to place a side bet, allowing them the possibility of winning a second amount based on the pointspread between the dealer's hand and each player's hand and according to a payoff table. Pointspread pay outs may vary as the rules of the game are selected by the house.

After all wagers have been made, dealing of the cards begins. As is customary in the play of Blackjack, the player is initially dealt two cards and the dealer is dealt two cards, one face up and one face down.

Play will continue according to the standard rules of the base game and the player will be paid winnings depending upon the pointspread by the player during that round.

One concern which might be envisioned in the play of this side bet game is the emotional impact on other players at the table. It is common for players to be emotionally affected by other players taking what is considered to be unwarranted hits, as it might influence the cards being dealt to latter players, including the dealer. It is thought that when a player has reached a point where the consideration of an additional hit might influence his natural or analytic tendencies of basic strategy, the interest of the other players in seeing a big win at their table would tend to ameliorate any considerations of play generally thought to be inconsistent with conventional strategy.

It is an aspect of the present invention to provide a new and exciting wagering opportunity for players of Blackjack.

Another aspect of the present invention is to provide a side bet opportunity which does not interfere with the players'strategy in playing the base game. The pointspreads are laid out such that the player will not be required to choose a playing strategy that is inconsistent with the generally accepted strategy of the base game. However, to the extent that a pointspread wager is made, a player is also provided an opportunity to factor such pointspread considerations and effectively add an insurance wager during the play.

It is a further aspect of the present invention to provide a side bet opportunity which will award the players winnings based on the pointspread between the dealer's hand and each player's hand and according to a payoff table.

Referring to FIG. 1, there is shown a standard gaming table 10, which is equipped with conventional items such as card discard holder 12, a money drop slot 14, and a dealer's chip tray 16. It should be noted that gaming tables for pointspread blackjack may be configured having various pieces of standard equipment or indicia as is known in the art.

The playing surface is preferably colorful felt but many other surfaces may be used. In the preferred embodiment, four player positions are indicated on the playing surface near the edge of table 10. The playing surface may be designed to accommodate any number of players. However, seven players are generally the maximum number which can be efficiently managed by a single dealer. A dealer position is indicated on the lower edge of the table so that the dealer can face each of the players and observe their play. Dealers position includes a dealer's chip tray 16 which may be used to store chips, tokens, coins, or bills.

The pointspread gaming table 10 is unique in that it has special indicia on the playing surface for placement of the pointspread main wagers or pointspread side bets. Additionally, the method of the present invention is generally carried out by having a house dealer handle all cards, although different dealing configurations are possible. The method of the present invention will begin by a player placing a bet to participate in the Twenty-One game on main wagering area 18. This wager may consist of any monetary amount depending on the wagering limits set up by the gaming establishment. At the beginning of each game, each player may place wagers in the form of chips, tokens, coins, or bills in wager position 18. The player is then given the opportunity to place a side bet on pointspread wagering area 20. These wagers may be made simultaneously, or wagers may be made throughout the play of the game. It a preferred embodiment, the pointspread wager is made prior to dealing the cards.

The next step of play begins by the dealer dealing the initial cards. In a preferred embodiment and as is customary in the game of Twenty-One, two cards are dealt face up to each of the players, while two cards are dealt to the dealer—one face up and one face down.

Following the initial resolution of any extraneous side bets, the player is then asked whether they would like another card (take a hit) or would like to stay with the cards as dealt. Also, the player is given other options at this point, including "splitting" cards or "doubling down". Each of these options are well known by Twenty-One players and will eventually require the player to take another card. If the player decides to take a hit, the dealer will deal an additional card to the player. Following the deal of this additional card, any extraneous side bet may again be resolved.

The house may establish rules for the play of the consecutive card side bet game of the present invention in the event of a twenty-one by the dealer. The two ways of house play at present are a) a view by the dealer of the first two cards (with allowance of time for 'Insurance' if an ace is shown by the dealer) with Black-Jacks displayed before players can take hits, or b) allowance of play of the game, with all players taking hits as desired and the dealer examining his cards only after the cessation of hits by the other players. In the first option, the house may choose from among 1) non-pointspread side bets captured by a Black-Jack, 2) non-pointspread side bets which are a draw against a Black-Jack, or 3) those players with side bets in play may continue, but all other players are out of the play. In the second and/or third options, the players no-pointspread side bets may be kept in play pending resolution of the hand or may be added to the pointspread wagers pending resolution of the pointspread wagers and then paid out according to the resulting multiple or jackpot.

It is also to be noted that the term 'dealer' is not intended to be limited to an animate dealer in the practice of the present invention. The dealer may be a mechanical device, virtual device or programmed dealing means, as in video black-jack games. The dealer may also include a mechanical or human dealer in combination with a mechanical shuffler. To avoid excessive pay outs, the house or promoter of the side bet game might well prefer mechanical shuffling systems, such as those manufactured by Shuffle Master, Inc. Quality dealing machines can avoid channeling or grouping of cards which an astute player might be able to track through replay of shoes. After any extraneous side bet opportunity has again been resolved, the method of the present game will loop back to where the player will again be asked if they would like to hit or stand. If the player chooses to hit once again, the process moves back to where the dealer will deal an additional card and then to where any extraneous side bet (i.e. any side bet not involving the pointspread side bets) will again be resolved.

The process then loops back to where the player is again asked to hit or stand. As can be seen, this loop of could continue for an indefinite number of rounds, depending upon the cards received by the players.

Also as is well known in the game of Twenty-One, this loop will end if the player breaks or busts (receiving a card total over 21).

If the player decides to stand, the method of the present wagering game moves on to where the dealer will complete the hand. More specifically, the dealer will deal the remaining house cards according to well-established house rules. In all professional environments, this involves dealing cards to the dealer's hand such that hits are taken anytime the card total is 16 or under, while standing with any card total equaling 17 or better.

The game description above involves a situation wherein the player and the dealer are the only two individuals participating in a hand of Twenty-One. It is understood and contemplated, however, that any side bet of the present invention may be played simultaneously by numerous players, including those in the game and those observing the game. In this situation, time delays may occur in the dealing sequence while cards are dealt to other players. For example, each player will have the opportunity to play their cards before the dealer completes the hand.

Following the completion of the Twenty-One hand, the method of the present game moves on to where all bets are resolved in the Twenty-One game. As is also well known by those skilled in the art of Twenty-one, this resolution includes pay outs for all players who have a card total exceeding that of the dealer while also staying under a card total of 21.

One or more of the side bets may be made prior to the deal of the first card in each hand by placing the appropriate wager in a side bet designation areas (not shown). Side bet area 20 indicates a side bet for any pointspread.

Figure 2:
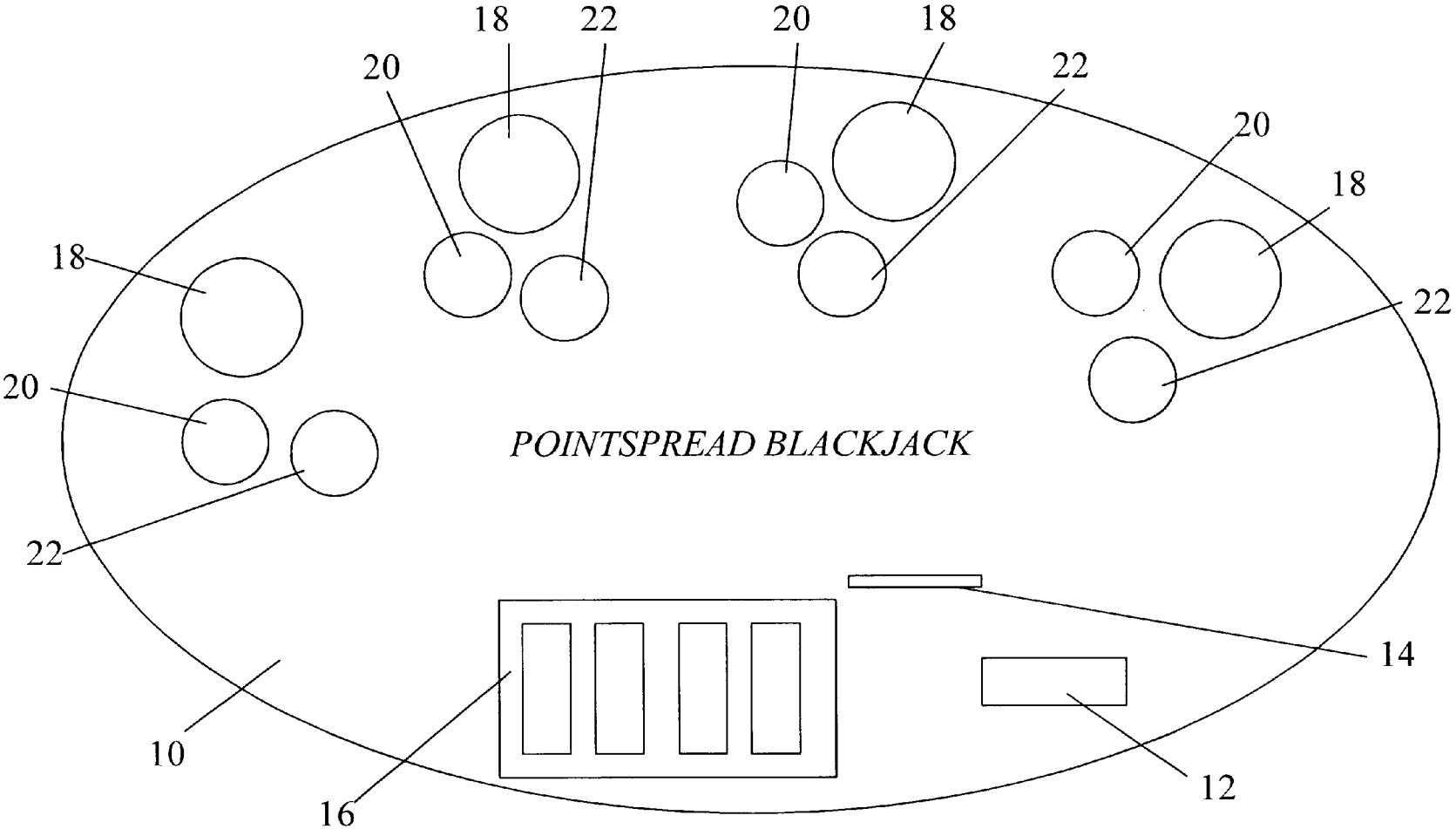
FIG. 2 is a top view of a gaming table layout of one embodiment of the game of the invention.

FIG. 2 shows side bet area 22 which may be used for a second side bet, such as an insurance bet either on the main or pointspread wager.

Figure 3:
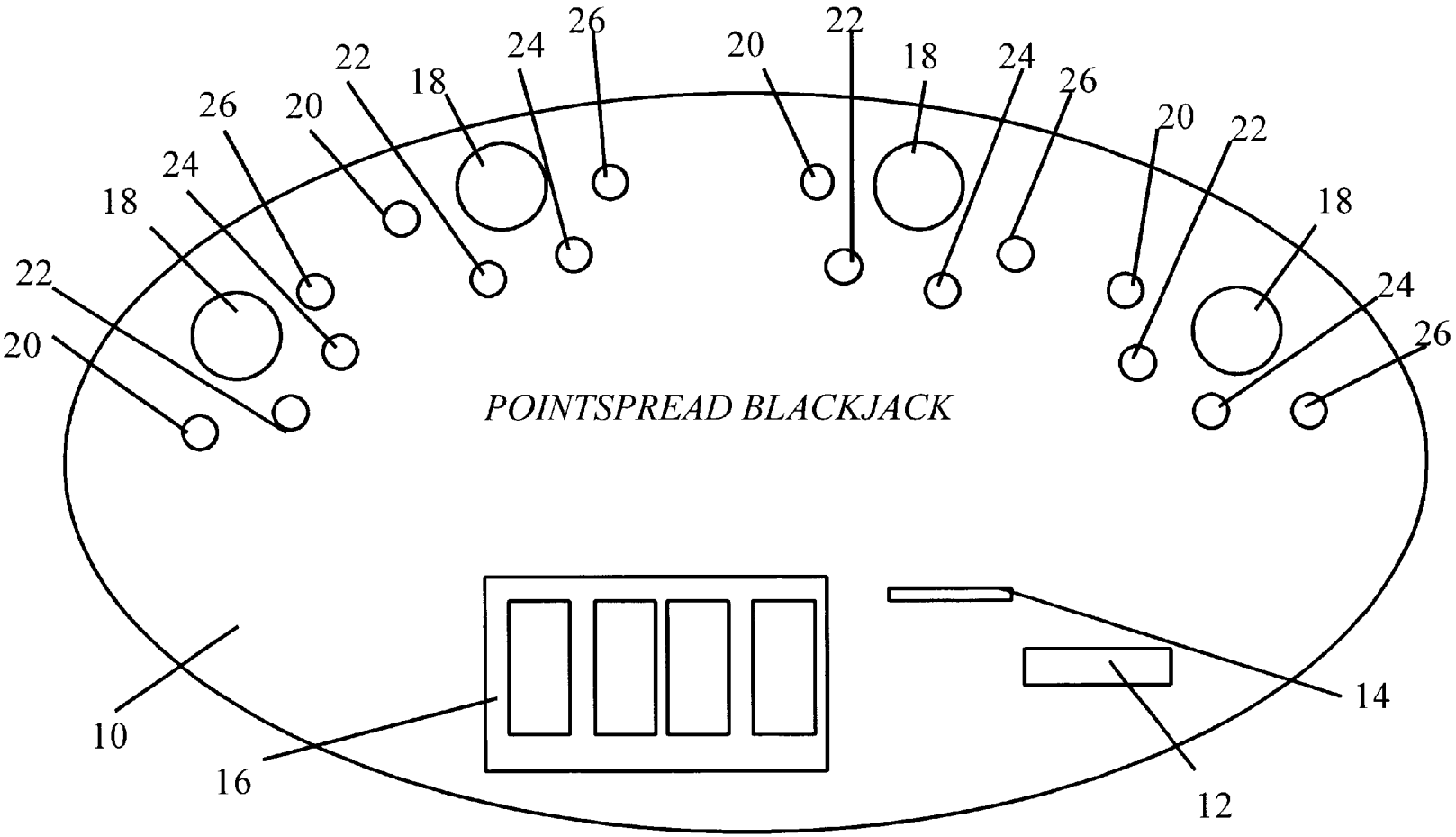
FIG. 3 is a top view of a gaming table layout of one embodiment of the game of the invention.

In another preferred embodiment, FIG. 3 shows a table having side bet areas specifically dedicated for each particular pointspread. In particular, side bet area 20 is used when placing a wager on pointspreads of one (1), side bet area 22 is used for placing a wager on pointspreads of two (2), side bet area 24 is used for placing a wager on pointspreads of three (3), and side bet area 26 is used for placing a wager on pointspreads of four (4). Tables showing an additional area for pointspreads of zero where the dealer's hand is equal to the player's hand are also contemplated although not shown in FIG. 3.

Since in all professional games dealers are required to hit on 16 or less, pointspreads of more than 4 would not occur. However, the present invention also includes such unconventional games wherein pointspreads of 5 or more, and the resulting payout multiple, can occur.

These types of games practiced within the scope of the present invention are readily distinguished from such games as Over-Under. The present games require a pointspread between the dealer's hand and each player's hand and according to a payoff table. Games such as Over-Under still rely on value totals for the cards dealt as the defining value for winning or losing. The term 'pointspread' in the practice of this invention means the numerical difference (Z) between the total value of the cards held by the player (X) and the total numerical value of the cards held by the dealer (Y), or mathematically represented as X−Y=Z. In the best mode of the invention, face cards have a value of ten. In another preferred embodiment face card values or rankings modify the pointspread payout or multiplier.

Additionally, standard pay outs are made according to the outcome of the underlying Twenty-One game. As discussed above for the preferred embodiment of the invention, the winnings for the pointspread are be as follows:

TABLE 1

| Pointspread To Win By | Payout Amount/Multiple |
|---|---|
| 1 | 1X |
| 2 | 1.5X |
| 3 | 2X |
| 4 | 10X |

Table 2 shows another embodiment, as discussed above:

TABLE 2

| Pointspread To Win By | Payout Amount/Multiple |
|---|---|
| 1 | 1X |
| 2 | 2X |
| 3 | 3X |
| 4 | 5X |

Table 3, discussed previously, shows another preferred embodiment of the invention:

TABLE 3

| Pointspread To Win By | Payout Amount/Multiple |
|---|---|
| 0 | 0.5X |
| 1 | 1X |
| 2 | 1.5X |

TABLE 3-continued

| Pointspread To Win By | Payout Amount/Multiple |
|---|---|
| 3 | 3X |
| 4 | 5X |

Additional embodiments may include standard amounts, based upon an initial wager of $1.00 as shown in Table 4:

TABLE 4

| Pointspread | | Payout Amount |
|---|---|---|
| 1 | $ | 1.00 |
| 2 | | 5.00 |
| 3 | | 10.00 |
| 4 | | 100.00 |

Stated differently, the pay outs may be more generally described as follows in Table 6:

TABLE 6

| Pointspread | Payout Amount/Multiple |
|---|---|
| 1 | A |
| 2 | B |
| 3 | C |
| 4 | D |

wherein A is a first predetermined amount or multiple, B is a second predetermined amount or multiplier, C is a third predetermined amount or multiple, and D is a fourth predetermined amount or multiple. The predetermined amounts or multipliers are specified dollar values, as shown in the first schedule, or are multiples of the player's wager.

The following table is an example of a pay table which may be used to define the pointspreads and payout ratios:

TABLE 7

| POINT SPREAD | PAYOUT RATIO |
|---|---|
| 1 | 1:1 |
| 2 | 4:1 |
| 3 | 10:1 |
| 4 | 100:1 |

Based on this pay table, a player will determine the possible winning pointspreads and their payout ratios and the house will determine the risk/advantage of a particular game.

The following table is another example of a pay table which may be used to define the pointspreads and payout ratios:

TABLE 8

| POINT SPREAD | PAYOUT RATIO |
|---|---|
| 1 | 2:1 |
| 2 | 3:1 |
| 3 | 5:1 |
| 4 | 10:1 |

Based on this pay table, a player will determine the possible winning pointspreads and their payout ratios.

The following table is an example of a pay table which may be used to define the pointspreads and payout ratios:

TABLE 9

| POINT SPREAD | PAYOUT RATIO |
|---|---|
| 1 | 2:1 |
| 2 | 8:1 |
| 3 | 32:1 |
| 4 | 128:1 |

Based on this pay table, a player will determine the possible winning pointspreads and their payout ratios.

The following table is an example of a pay table which may be used to define the pointspreads and payout ratios:

TABLE 10

| POINT SPREAD | PAYOUT RATIO |
|---|---|
| 1 | 1:1 |
| 2 | 2:1 |
| 3 | 3:1 |
| 4 | JACKPOT |

Based on this pay table, a player will determine the possible winning pointspreads and their payout ratios as well an added excitement of a potential jackpot payoff. This payout may be indicated on a large display by the house to generate interest as well providing a mechanism to vary the house advantage.

The motivating concept of this side bet is to provide the players with an additional wagering opportunity wherein very large pay outs are possible. Also, the side bet provides a mechanism to create additional excitement when playing the base game.

The payout schedule is calculated based on the probability of players receiving these hands, the estimated number of players participating, the required expenses for the casino to offer the side bet opportunity, and the desired profit levels. From all this information, appropriate pay outs are calculated and advertised as predetermined amounts to be paid upon receipt of appropriate hands.

A number of characteristics make the present game very exciting and enticing for the players. Obviously there is the opportunity to win large amounts of money in addition to the amount won in the base game.

Secondly, the present game creates excitement and anticipation while the cards are being dealt to the players. As the player is playing, they will initially watch for the first card received and then anticipate receipt of additional cards during the deal.

Lastly, the side bet is won by the players upon receipt of appropriate cards.

While the present method has been described in the context of a live casino table game, this method is equally applicable to other presentations. For example, the method of the present wagering game is easily carried out by a video machine having a display and interactive buttons. In this embodiment, the video machine would have a video screen which would display all cards to the players. The player then uses the interactive buttons to make "hit or stand" decisions.

Additionally, as other technologies become increasingly available, this game will be adapted for use in other arenas. One common example of this is the use of the present wagering game as a computer video game. The invention also includes games which take the form of a CD ROM or computer diskette which is loaded into a standard personal computer and handheld gaming systems which allow portable play in numerous different locations. Lastly, other types of installed computerized systems may be configured to carry out the method of the present game such as display systems on aircraft or busses etc.

The above-mentioned method can be altered in a specific configuration without departing from the principles of the invention. We claim all modifications coming within the scope and spirit of the following claims.

REFERENCE NUMERALS

10 gaming table
12 card discard holder
14 money drop slot
16 dealer chip area
18 player's main wagering area
20 wagering area for pointspread of 1
22 wagering area for pointspread of 2
24 wagering area for pointspread of 3
26 wagering area for pointspread of 4

In the preferred embodiment, the wagers are in addition to a standard wager which may be placed on player card areas 24*a–g* or in another part of the table. The standard wager is be resolved according to the rules of standard black jack. Alternatively, no standard wager may be made and the wagers placed on wager positions 28*a–g* and 30*a–g* may be the only wagers made by the players.

In an alternate preferred embodiment, a player may wager on a dealer wager position wherein the player will be wagering on the dealer's hand and any pointspread resulting therefrom.

While the invention has been described with reference to specific embodiments, other variations or modifications will be apparent to those of skill in the art. Therefore, the invention should not be limited by the foregoing, but rather the scope of the following claims is intended to be interpreted using the entire specification, the knowledge of a person of ordinary skill in the art, the prior art, as well as any extrinsic factors necessary to clarify unforeseen ambiguity in accordance with present or existing laws.

I claim:

1. A method of providing an increased payout in a black jack card game with money, gaming chips, and/or credits by one or more players playing against a dealer, the method comprising the steps of:

(a) providing each player an opportunity to make a wager to participate in the black jack card game;

(b) the dealer dealing each player a player hand of two cards, and the dealer dealing a dealer hand of two cards, and the player and the dealer taking hits according to the rules of black jack;

(c) comparing each of the players'hands with the dealer's hand to identify winning players and losing players; and (d) resolving each player's wager by taking the wagers of losing players according to the rules of blackjack and paying off winning players according to a payoff table that multiplies a conventional blackjack payoff by a scale factor that varies as a function of the magnitude of a pointspread between the dealer's hand and the respective winning player's hand.

2. The method of claim 1, wherein the wager is a side wager.

3. The method of claim 1, wherein the wager is a main wager.

4. The method of claim 3, further comprising the steps of:

(e) providing each player an opportunity to make a side wager representing a wager on the pointspread between the dealer's hand and each player's hand; and (f) paying each player according to the pointspread between the dealer's hand and each player's hand and according to a payoff table.

5. The method of claim 1, further comprising the step of:

(e) providing a gaming surface having a wagering area with indicia representing a pointspread between the dealer's hand and each player's hand and upon which each player may place the money, gaming chips, and/or credits representing the wager.

6. The method of claim 1, wherein the method is played using a device selected from the group consisting of:

video game devices, software operated computer game devices, scratch-off type playing cards, and pull-tab type gaming cards.

7. The method of claim 1, wherein the method is played using a conventional deck of playing cards.

8. The method of claim 1, wherein the method is played using a nonconventional deck of playing cards.

9. The method of claim 1, wherein the payout is made according to Table 1:

TABLE 1

| Pointspread To Win By | Payout Amount/Multiple |
|---|---|
| 1 | 1X |
| 2 | 1.5X |
| 3 | 2X |
| 4 | 10X |

10. The method of claim 1, wherein the payout is made according to Table 2:

TABLE 2

| Pointspread To Win By | Payout Amount/Multiple |
|---|---|
| 1 | 1X |
| 2 | 2X |
| 3 | 3X |
| 4 | 5X |

11. The method of claim 1, wherein the payout is made according to Table 3:

TABLE 3

| Pointspread To Win By | Payout Amount/Multiple |
|---|---|
| 0 | 0.5X |
| 1 | 1X |
| 2 | 1.5X |
| 3 | 3X |
| 4 | 5X |

12. A method of playing a black jack card game with money, gaming chips, and/or credits by one or more players playing against a dealer, the method comprising the steps of:

(a) providing each player an opportunity to make a wager to participate in the black jack card game;

(b) the dealer dealing each player a player hand of two cards, and the dealer dealing a dealer hand of two cards, and the player and the dealer taking hits according to the rules of black jack;

(c) comparing each of the players'hands with the dealer's hand to identify winning players and losing players; and (d) the dealer resolving the wager by taking the wagers of losing players according to the rules of blackjack and paying off winning players according to a payoff table that multiplies a conventional blackjack payoff by a scale factor that varies as a function of the magnitude of a pointspread between the dealer's hand and the respective winning player's hand.

13. The method of claim 12, further comprising the steps of:

(e) providing each player an opportunity to make a side wager representing a wager on the pointspread between the dealer's hand and each player's hand; and (f) paying each player according to the pointspread between the dealer's hand and each player's hand and according to a payoff table.

14. The method of claim 12, further comprising the step of:

(e) providing a gaming surface having a wagering area with indicia representing a pointspread between the dealer's hand and each player's hand.

15. The method of claim 12, wherein the method is played using a device selected from the group consisting of: video game devices, software operated computer game devices, scratch-off type playing cards, and pull-tab type gaming cards.

16. The method of claim 12, wherein the method is played using a conventional deck of playing cards.

17. The method of claim 12, wherein the method is played using a nonconventional deck of playing cards.

18. The method of claim 12, wherein the payout is made according to Table 1:

TABLE 1

| Pointspread To Win By | Payout Amount/Multiple |
|---|---|
| 1 | 1X |
| 2 | 1.5X |
| 3 | 2X |
| 4 | 10X |

19. The method of claim 12, wherein the payout is made according to Table 2:

TABLE 2

| Pointspread To Win By | Payout Amount/Multiple |
|---|---|
| 1 | 1X |
| 2 | 2X |
| 3 | 3X |
| 4 | 5X |

20. The method of claim 12 wherein the payout is made according to Table 3:

TABLE 3

| Pointspread To Win By | Payout Amount/Multiple |
|---|---|
| 0 | 0.5X |
| 1 | 1X |
| 2 | 1.5X |
| 3 | 3X |
| 4 | 5X |

21. A method of providing an additional wagering opportunity based on a magnitude of a pointspread between a dealer's hand and each player's hand in a black jack card game with money, gaming chips, and/or credits by one or more players playing against a dealer, the method comprising the steps of:

(a) providing each player an opportunity to make a main wager to participate in the black jack card game and an opportunity to make a side wager representing a wager on a magnitude of the pointspread between the dealer's hand and the respective player's hand;

(b) the dealer dealing each player a player hand of two cards, and the dealer dealing a dealer hand of two cards, and the player and the dealer taking hits according to the rules of black jack;

(c) comparing each of the players'hands with the dealer's hand to identify winning players and losing players and the dealer resolving the main wagers by paying off winning players and taking the wagers of losing players according to the rules of blackjack; and (d) paying each winning player's side wager according to a payoff table that varies as a function of the magnitude of the pointspread between the dealer's hand and the respective winning player's hand.

22. The method of claim 21, further comprising the step of:

(e) providing a gaming surface having a wagering area with indicia representing a pointspread between the dealer's hand and each player's hand.

23. The method of claim 21, wherein the method is played using a device selected from the group consisting of: video game devices, software operated computer game devices, scratch-off type playing cards, and pull-tab type gaming cards.

24. The method of claim 21, wherein the method is played using a conventional deck of playing cards.

25. The method of claim 21, wherein the method is played using a nonconventional deck of playing cards.

26. The method of claim 21, wherein the payout is made according to Table 1:

TABLE 1

| Pointspread To Win By | Payout Amount/Multiple |
|---|---|
| 1 | 1X |
| 2 | 1.5X |
| 3 | 2X |
| 4 | 10X |

27. The method of claim 21, wherein the payout is made according to Table 2:

TABLE 2

| Pointspread To Win By | Payout Amount/Multiple |
|---|---|
| 1 | 1X |
| 2 | 2X |
| 3 | 3X |
| 4 | 5X |

28. The method of claim 21, wherein the payout is made according to Table 3:

TABLE 3

| Pointspread To Win By | Payout Amount/Multiple |
|---|---|
| 0 | 0.5X |
| 1 | 1X |
| 2 | 1.5X |
| 3 | 3X |
| 4 | 5X |

29. A method of calculating a house advantage for pointspread blackjack, comprising:

providing a standard computer having software programming; and i) inputting into said computer data, variables, and/or objects relating to a basic game of blackjack;

ii) inputting into said computer data, variables and/or objects relating to pointspread blackjack including a magnitude of a pointspread amount, a payout multiple that varies as a function of the magnitude of the pointspread amount, and the number of decks of playing cards used by a dealer; and iii) calculating with said computer a value of the house advantage over each player.

30. The method of claim 29, wherein a blackjack game having a pointspread of 1, 2, 3, or 4 results in 1×, 1.5×, 2× or 10× payout respectively and wherein the value of the house advantage ranges from 5.15% for 2 decks of cards in a dealer tray to 5.32% for six decks for players using a basic strategy, and the house advantage is 2.43% for 2 decks to 2.53% for 6 decks for players using a dealer mimic strategy wherein a player hits to 17 regardless of a dealer's up card.

31. The method of claim 29, wherein a blackjack game having a pointspread of 1, 2, 3, or 4 results in 1×, 2×, 3×, or 5× payout respectively and wherein the value of the house advantage ranges from 6.25% for 2 decks to 6.36% for 6 decks of cards in a dealer tray, and the house advantage is 3.77% for 2 decks to 3.80% for 6 decks for players using a dealer mimic strategy wherein a player hits to 17 regardless of a dealer's up card.

32. The method of claim 29, wherein a blackjack game having a pointspread of 0 (a tie), 1, 2, 3, or 4 results in 0.5×, 1×, 1.5×, 3× or 5× payout, respectively, of a side bet and wherein the value of the house advantage ranges from 5.19% for 2 decks to 5.28% for 6 decks for a player using a basic strategy, and the house advantage for a player using the mimic strategy results in 2.56% for 2 decks and 2.57% for 6 decks.

* * * * *